US007325527B2

(12) United States Patent
Hochmayr et al.

(10) Patent No.: US 7,325,527 B2
(45) Date of Patent: Feb. 5, 2008

(54) OIL PUMP ARRANGEMENT FOR AN INTERNAL COMBUSTION ENGINE

(75) Inventors: Markus Hochmayr, Krenglbach (AT); Herbert Poelz, Gunskirchen (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 11/559,780

(22) Filed: Nov. 14, 2006

(65) Prior Publication Data

US 2007/0181092 A1 Aug. 9, 2007

Related U.S. Application Data

(60) Provisional application No. 60/736,861, filed on Nov. 16, 2005.

(51) Int. Cl.
*F01M 1/02* (2006.01)
*F02B 75/32* (2006.01)
*B62J 13/00* (2006.01)

(52) U.S. Cl. ..... 123/196 R; 123/197.1; 474/144

(58) Field of Classification Search ..... 123/196 R, 123/197.1, 195 C, 198 C; 474/144
See application file for complete search history.

(56) References Cited

U.S. PATENT DOCUMENTS 6,672,982 B2 1/2004 Ikusue et al.
6,962,096 B2 * 11/2005 Hojyo ..... 74/606 R
7,040,454 B2 * 5/2006 Kawamoto et al. ..... 184/106
7,165,651 B2 * 1/2007 Hiraga ..... 184/6.12
7,171,939 B1 * 2/2007 Tiller ..... 123/196 R
7,219,645 B2 * 5/2007 Lamb et al. ..... 123/196 R

FOREIGN PATENT DOCUMENTS

| | | | |
|---|---|---|---|
| DE | 326825 | C | 10/1920 |
| EP | 1170480 | A2 | 1/2002 |
| EP | 1258424 | A2 | 11/2002 |
| EP | 1477640 | A1 | 11/2004 |
| EP | 1503059 | A1 | 2/2005 |
| GB | 579383 | A | 8/1946 |

OTHER PUBLICATIONS

European Search Report of EP05110704, Munchen Dec. 8, 2005, Yates, J.

* cited by examiner

*Primary Examiner*—Stephen K. Cronin
*Assistant Examiner*—Hyder Ali
(74) *Attorney, Agent, or Firm*—Osler, Hoskin & Harcourt LLP

(57) ABSTRACT

An internal combustion engine has a power unit case having a crankcase, a first housing flange and a second housing flange. The crankshaft axis and the output shaft axis define a reference plane. An oil pump has an oil pump shaft, having an oil pump shaft axis, disposed at least partially in an oil pump chamber. A normal projection of the oil pump shaft axis onto the reference plane is located between the crankshaft axis and the output shaft axis. A first housing cover is mounted to the first housing flange on a first side of the power unit case. A separate oil pump cover is mounted to the second housing flange on the first side of the power unit case to close the oil pump chamber.

20 Claims, 6 Drawing Sheets

OIL PUMP ARRANGEMENT FOR AN INTERNAL COMBUSTION ENGINE

CROSS-REFERENCE

The present application claims priority to U.S. Provisional Patent Application No. 60/736,861 filed on Nov. 16, 2005, the entirety of which is incorporated herein by reference. The present application is also related to European Patent Application No. 05110704.3 , filed Nov. 14, 2005.

FIELD OF THE INVENTION

The present invention relates to an oil pump arrangement for an internal combustion engine.

BACKGROUND OF THE INVENTION

Various arrangements of the oil pump in an internal combustion engine are known from the prior art. One such arrangement is illustrated in U.S. Pat. No. 6,672,982 B2, issued on Jan. 6, 2004.

However, there is a need for an oil pump arrangement which results in an internal combustion engine which is compact and provides easy access for repair or maintenance operations of the oil pump.

SUMMARY OF THE INVENTION

It is an object of the present invention to provide an internal combustion engine having an oil supply system where an oil pump has an oil pump cover which is separate from a housing cover.

It is also an object of the present invention to provide a vehicle having an internal combustion engine which has an oil supply system where an oil pump has an oil pump cover which is separate from a housing cover.

It is also an object of the present invention to provide an internal combustion engine having an oil supply system where a flange to which an oil pump cover is mounted is closer to a vertical central plane of the engine than a flange to which a housing cover is mounted.

In one aspect, the invention provides an internal combustion engine comprising a power unit case having a crankcase, an integrated transmission housing, a first housing flange and a second housing flange. A crankshaft has first and second crankshaft ends. The crankshaft is supported for rotation about a crankshaft axis in the crankcase. The power unit case has a central plane defined as a vertical plane being perpendicular to the crankshaft axis and intersecting the crankshaft generally at a midpoint between the two crankshaft ends. An output shaft is supported for rotation about an output shaft axis in the crankcase. The output shaft axis and the crankshaft axis define a reference plane. A first oil pump has a first oil pump chamber disposed at least partially in the power unit case, an oil pump shaft disposed at least partially in the first oil pump chamber and being supported for rotation about an oil pump shaft axis, a normal projection of the oil pump shaft axis onto the reference plane being located between the crankshaft axis and the output shaft axis, and a first oil pump rotor disposed in the first oil pump chamber on the oil pump shaft so as to rotate therewith about the oil pump shaft axis. A first housing cover is mounted to the first housing flange on a first side of the power unit case. The first housing cover is removable, and, when mounted, forms part of the power unit case. The first housing cover is one of a clutch cover and an ignition cover. An oil pump cover is mounted to the second housing flange on the first side of the power unit case to close the first oil pump chamber. The oil pump cover is removable to provide access to the first oil pump chamber, and when mounted, forms part of the power unit case. The oil pump cover is separate from the first housing cover.

Preferably, the engine has a transmission shaft supported in the transmission housing for rotation about a transmission shaft axis.

Preferably, the crankshaft axis is parallel to and spaced apart from both the transmission shaft axis and the output shaft axis.

Preferably, the engine has a primary drive disposed on the crankshaft for driving the transmission shaft, and a series of gears disposed on the transmission shaft for driving the output shaft.

Preferably, the engine has a clutch chamber, wherein a portion of the transmission shaft is disposed in the clutch chamber, and a clutch disposed on the transmission shaft in the clutch chamber. The first housing cover is a clutch cover to close the clutch chamber. The clutch cover is removable to provide access to the clutch chamber.

Preferably, the engine has an ignition chamber, wherein the first end of the crankshaft is disposed in the ignition chamber, and a generator-ignition system disposed on the first end of the crankshaft in the ignition chamber. The first housing cover is an ignition cover to close the ignition chamber. The ignition cover is removable to provide access to the ignition chamber.

Preferably, a normal projection of the second housing flange onto the central plane does not overlap a normal projection of the first housing flange onto the central plane.

Preferably, the second housing flange is closer to the central plane than the first housing flange.

Preferably, the complete oil pump cover is closer to the central plane than the first housing flange.

Preferably, the engine has an output wheel disposed on the output shaft for rotation therewith. The output wheel is disposed outside of the power unit case adjacent to the oil pump cover.

Preferably, the output wheel is one of a sprocket and a notched-belt pulley.

Preferably, the engine has an output wheel disposed on the output shaft for rotation therewith. The output wheel is disposed outside of the power unit case. The oil pump cover is closer to the central plane than the output wheel.

Preferably, the engine has an output wheel disposed on the output shaft for rotation therewith. The output wheel is disposed outside of the power unit case. The second flange housing is closer to the central plane than the output wheel.

Preferably, the first oil pump chamber disposed at least partially in the crankcase, a first end portion of the oil pump shaft is disposed in the first oil pump chamber, and the first oil pump rotor is disposed on the first end portion. The engine also has a second oil pump. The second oil pump has a second oil pump chamber disposed at least partially in the crankcase, a second end portion of the oil pump shaft is disposed in the second oil pump chamber, and a second oil pump rotor disposed in the second pump chamber on the second end portion so as to rotate with the oil pump shaft about the oil pump shaft axis.

Preferably, the first pump is a suction pump and the second pump is a pressure pump.

In another aspect, the invention provides a vehicle having a frame, a straddle-type seat mounted to the frame, at least two wheels mounted to the frame, a handlebar operatively connected to at least one of the wheels for steering the vehicle, and an internal combustion engine mounted to the frame below the straddle-type seat and operatively connected to at least one of the wheels. The engine has a power unit case having a crankcase, an integrated transmission housing, a first housing flange and a second housing flange. A crankshaft has first and second crankshaft ends. The crankshaft is supported for rotation about a crankshaft axis in the crankcase. The power unit case has a central plane defined as a vertical plane being perpendicular to the crankshaft axis and intersecting the crankshaft generally at a midpoint between the two crankshaft ends. An output shaft is supported for rotation about an output shaft axis in the crankcase. The output shaft axis and the crankshaft axis define a reference plane. A first oil pump has a first oil pump chamber disposed at least partially in the power unit case, an oil pump shaft disposed at least partially in the first oil pump chamber and being supported for rotation about an oil pump shaft axis, a normal projection of the oil pump shaft axis onto the reference plane being located between the crankshaft axis and the output shaft axis, and a first oil pump rotor disposed in the first oil pump chamber on the oil pump shaft so as to rotate therewith about the oil pump shaft axis. A first housing cover is mounted to the first housing flange on a first side of the power unit case. The first housing cover is removable, and, when mounted, forms part of the power unit case. The first housing cover is one of a clutch cover and an ignition cover. An oil pump cover is mounted to the second housing flange on the first side of the power unit case to close the first oil pump chamber. The oil pump cover is removable to provide access to the first oil pump chamber, and when mounted, forms part of the power unit case. The oil pump cover is separate from the first housing cover.

Preferably, the vehicle is a motorcycle.

Preferably, the at least two wheels are four wheels.

Preferably, the vehicle is an all-terrain vehicle.

For purposes of this application, the term "flange" designates the separating surface on which a cover of the power unit case is either flange-mounted or secured. It is also possible to install a gasket between the separating surface of the power unit case and the cover, which in the flange-mounted state forms part of the outer power unit case. Also, terms describing spatial orientation, such as "vertical" should be understood with reference the internal combustion engine described herein being oriented with the crankshaft being disposed horizontally.

Embodiments of the present invention each have at least one of the above-mentioned objects and/or aspects, but do not necessarily have all of them.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
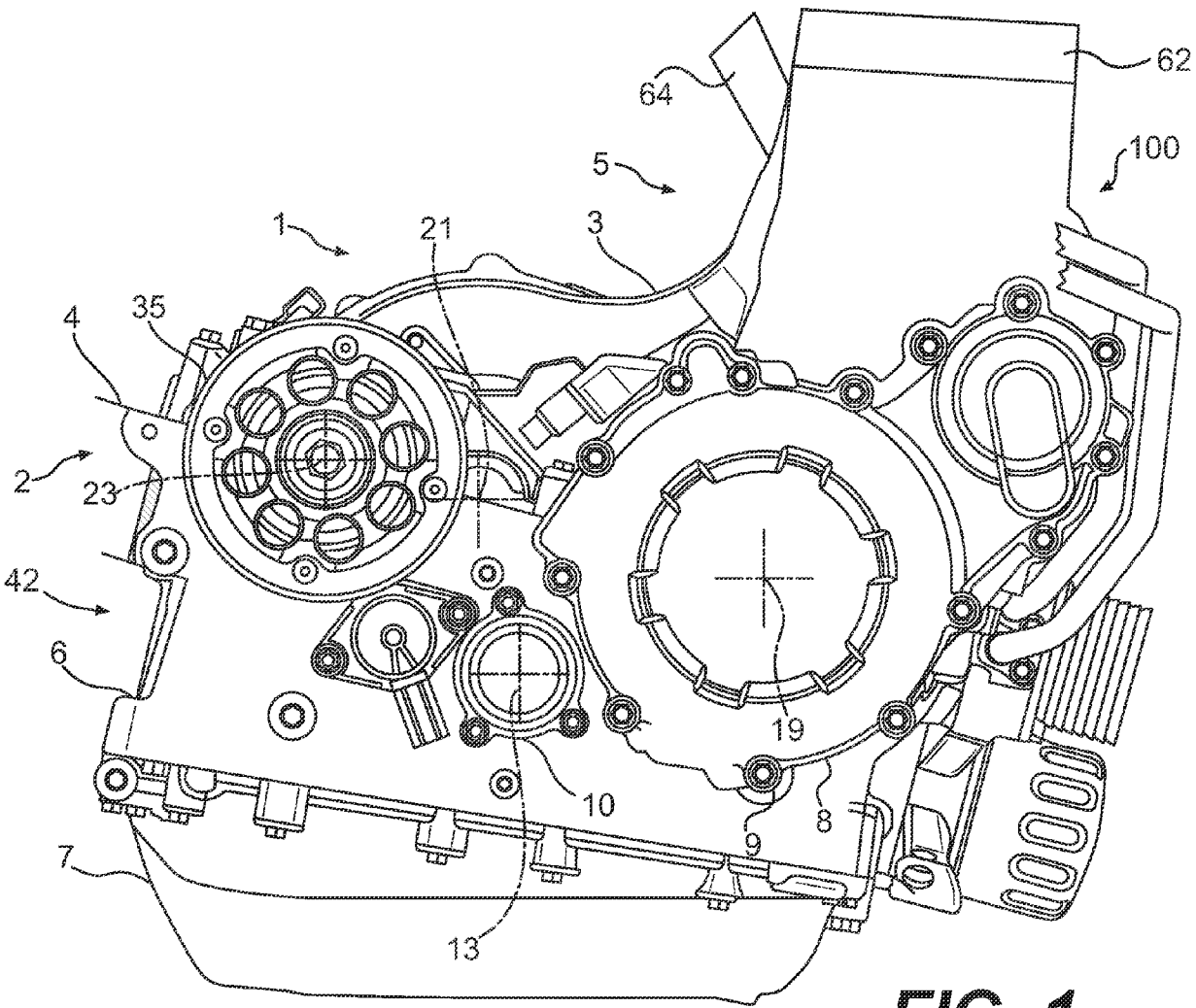
FIG. 1 is a side view of an internal combustion engine having an oil supply system according to the present invention.

As shown in FIG. 1, an internal combustion engine 100 has an power unit case 1. The power unit case 1 includes a crankcase 2 that is divided into a cylinder block portion 3, which includes the upper part of the crankcase 2 and a cylinder block 5, and a lower crankcase half 6 along a separating plane 4. An oil sump 7 is secured to the lower crankcase half 6. A cylinder head assembly 62 sits atop the cylinder block 5. The cylinder block 5 has two cylinders (not shown) inside each of which one of the pistons 27 or 28 reciprocates. Each of the pistons 27, 28 together with the side wall of its corresponding cylinder and the corresponding portion of the cylinder head assembly 62 forms a combustion chamber (not shown). Since the internal combustion engine 100 of the present invention is preferably a four-cycle engine, at least one intake valve per cylinder (not shown) and at least one exhaust valve per cylinder (not shown) are provided in the cylinder head assembly 62. Two intake valves and two exhaust valves per cylinder are preferably provided. A single overhead camshaft (not shown) disposed in the cylinder head assembly 62 and operatively connected to the crankshaft 24, controls the actuation of the intake and exhaust valves. It is contemplated that two overhead camshafts (one for the intake valves and one for the exhaust valves) could be used. A fuel injector (not shown) and a spark plug (not shown) per cylinder are also provided in the cylinder head assembly 62. A pair of throttle bodies 64 (one per cylinder) are used to regulate the quantity of air entering the combustion chambers. An air intake manifold (not shown) or an airbox (not shown) or both, are provided upstream of and in fluid communication with the throttle bodies 64. An exhaust manifold (not shown) in fluid communication with each combustion chamber is provided on the side of the cylinder block 5 opposite the side where the throttle bodies 64 are provided. The exhaust manifold is in fluid communication with the exhaust system of the vehicle incorporating the engine 100. It would be understood that the engine 100 also has other elements and systems not specifically shown and/or described in the present application. These can include, but are not limited to, a starter motor, an oil filter, a cooling system, an electrical system, and a fuel injection system.

Figure 3:
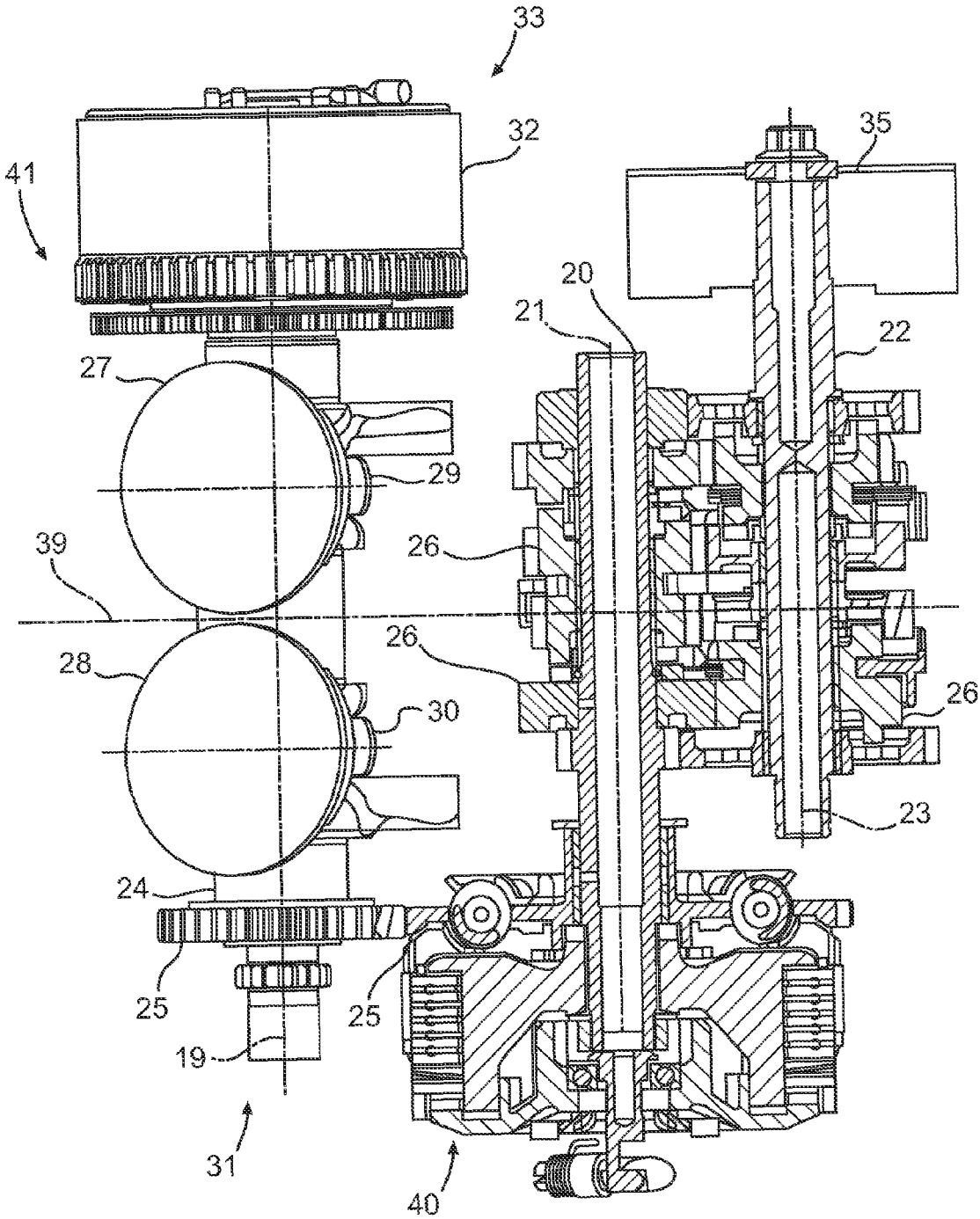
FIG. 3 is a top view of internal components of the internal combustion engine shown in FIGS. 1 and 2.

The power unit case 1 also includes an integrated transmission housing 42 which can be made in integrally with the crankcase 2 or fastened to the crankcase 2, with bolts for example. The side part of the power unit case 1 has a first housing cover 8 that is secured by at least one fastener 9, such as a screw, to the crankcase 2. When mounted, the first housing cover 8 forms part of the power unit case 1. In the present embodiment, the first housing cover 8 is an ignition cover which can be removed to provide access to an ignition chamber 33 (FIG. 3). The ignition chamber 33 is the space inside the power unit case 1 within which the ignition system or generator-ignition system 32 (FIG. 3) is located. The ignition chamber can be part of the crankcase 2 or can be partially separated from the crankcase 2.

A oil pump cover 10, which is separate from the first housing cover 8, is located beside the first housing cover 8.

Figure 2:
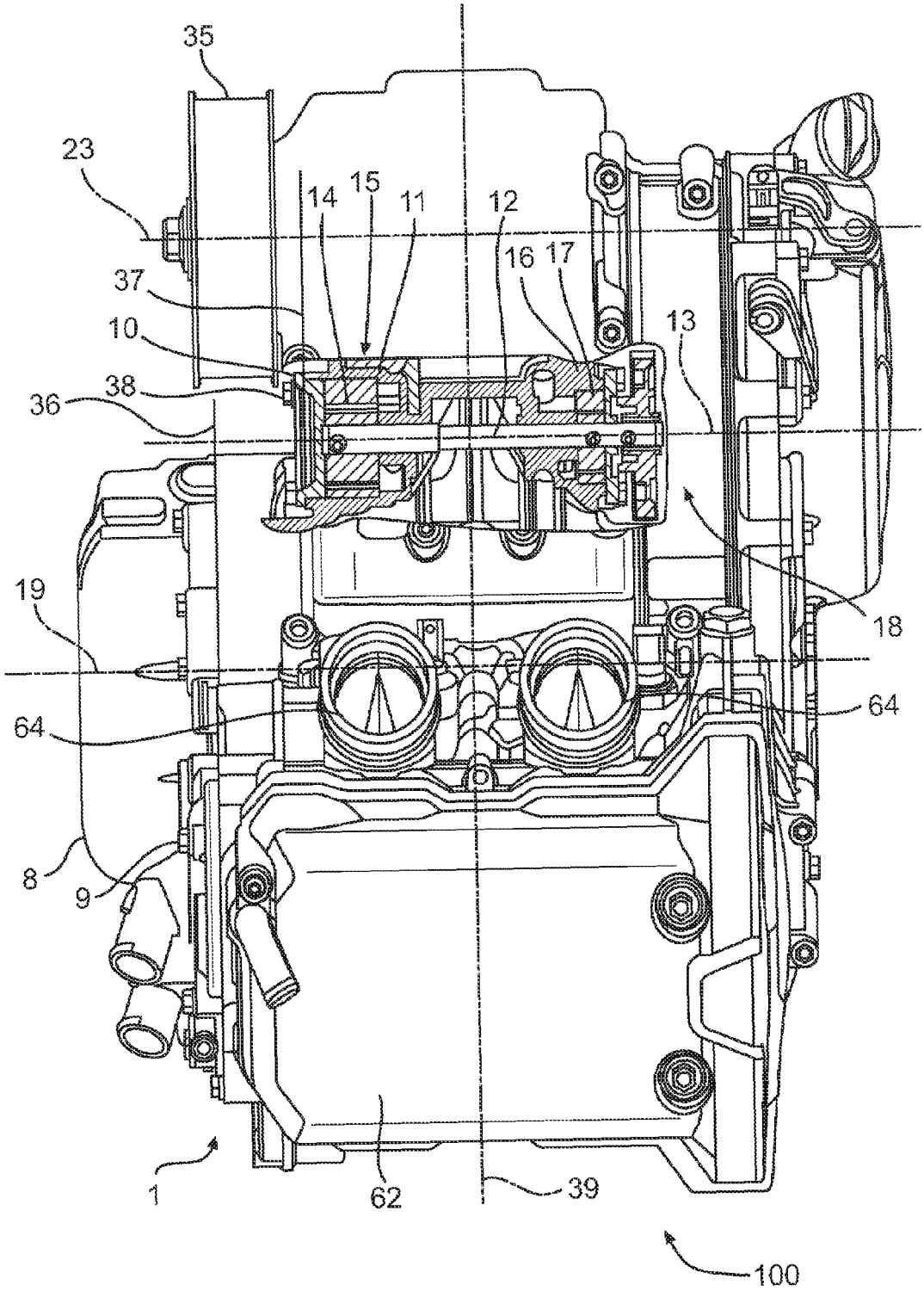
FIG. 2 is a top plan view of the internal combustion engine shown in FIG. 1, with an oil pump device of the engine shown in partial cross-section.

When mounted, the oil pump cover 10 forms part of the power unit case 1. The oil pump cover 10 can be removed to provide access to a first oil pump chamber 11 (FIG. 2). As seen in FIG. 2, located behind the oil pump cover 10 is a first oil pump 15 having an oil pump shaft 12 defining an oil pump shaft axis 13 and a first oil pump rotor 14. The first oil pump rotor 14 is connected to an end portion of the first oil pump shaft 12 so as to rotate therewith. The first oil pump rotor 14 is disposed in the first oil pump chamber 11. A second oil pump rotor 17 of a second oil pump 18 is connected to the end portion of the oil pump shaft 12 opposite the end portion to which the first oil pump rotor 14 is connected. The second oil pump rotor 17 rotates together with the oil pump shaft 12 and is disposed in a second oil pump chamber 16. The oil pump shaft 12 is driven by the crankshaft 24 (FIG. 3) via gears, one of which is disposed on the end of the oil pump shaft 12 in the second oil pump chamber 16. The first oil pump 15 is a suction pump and the second oil pump 18 is a pressure pump. The suction pump draws oil from the oil pan (sump) into an oil tank, whereas the pressure pump takes oil from the oil tank and supplies it to various lubrication points. The oil pump shaft axis 13 is generally parallel to the crankshaft axis 19 of the crankshaft 24. The first and second oil pump chambers 11, 16 are disposed at least partially in the power unit case 1, and in a preferred embodiment they are disposed at least partially in the crankcase 2.

Turning now to FIG. 3, it can be seen that the internal combustion engine 100 has a transmission shaft 20 defining a transmission shaft axis 21 and an output shaft 22 defining an output shaft axis 23. The transmission shaft 20 is connected to the crankshaft 24 by way of a primary drive 25 and a clutch 40. The output shaft 22 is connected through a series of gears 26, through a transmission gear box for example, to the transmission shaft 20. A first reference plane passing through the crankshaft axis 19 and the output shaft axis 23 coincides with the separating plane 4 of the crankcase 2. The crankshaft 24, the transmission shaft 20, and the output shaft 22 are parallel to each other and are each arranged and/or supported in bearings bearing intersected by the separating plane 4 of the crankcase 2. As can be seen in FIG. 1, the oil pump shaft axis 13 shaft is disposed beneath the separating plane 4. By normally projecting the oil pump shaft axis 13 onto the first reference plane, the normal projection is located, along the first reference plane, between the crankshaft axis 19 and the output shaft axis 23.

As can be seen in FIG. 3, two pistons 27, 28 are connected to the crankshaft 24 by connecting rods 29, 30. The generator-ignition system 32 is disposed at the first end 41 of the crankshaft 24 and the primary drive 25, preferably a gear, for driving the transmission shaft 20 is disposed at the second end 31 of the crankshaft 24, opposite the first end. The generator-ignition system 32 is housed in the ignition chamber 33. As can be seen from FIGS. 1 and 3, an output wheel 35 is located on the output shaft 22 externally of the power unit case 1. This output wheel 35 can, for example, be in the form of a notched-belt pulley or a sprocket, and can be used to drive the rear axle of a motorcycle through a notched belt or chain.

Turning back to FIG. 2, it can be seen that the first housing cover 8 is mounted to a first housing flange 36. It is contemplated that a gasket could be installed between the surface of the first housing flange 36 and the first housing cover 8. As can also be seen from FIG. 2, the oil pump cover 10 is mounted to a second housing flange 37 and is secured to the surface of the second housing flange 37 or to the crankcase 2 by fasteners 38, such as bolts or screws. The second housing flange 37 located closer to a central plane 39 than the first housing flange 36. The central plane 39 is a vertical plane which is perpendicular to the crankshaft axis 19 and intersects the crankshaft 24 at or near the midpoint between the two ends 31, 41 of the crankshaft 24. The second housing flange 37 is also closer to the central plane 39 than the output wheel 35. In the present embodiment, the whole oil pump cover 10 is closer to the central plane 39 than the first housing cover 8 and the output wheel 35. By locating the oil pump cover 10 this way, it is possible to provide additional space in the area adjacent the oil pump cover 10, and this space can then be used to receive a larger output wheel 35 or other devices. For example, an exhaust pipe can be routed in this space so as to be close to the power unit case 1 thereby providing a more compact engine package.

Figure 4:
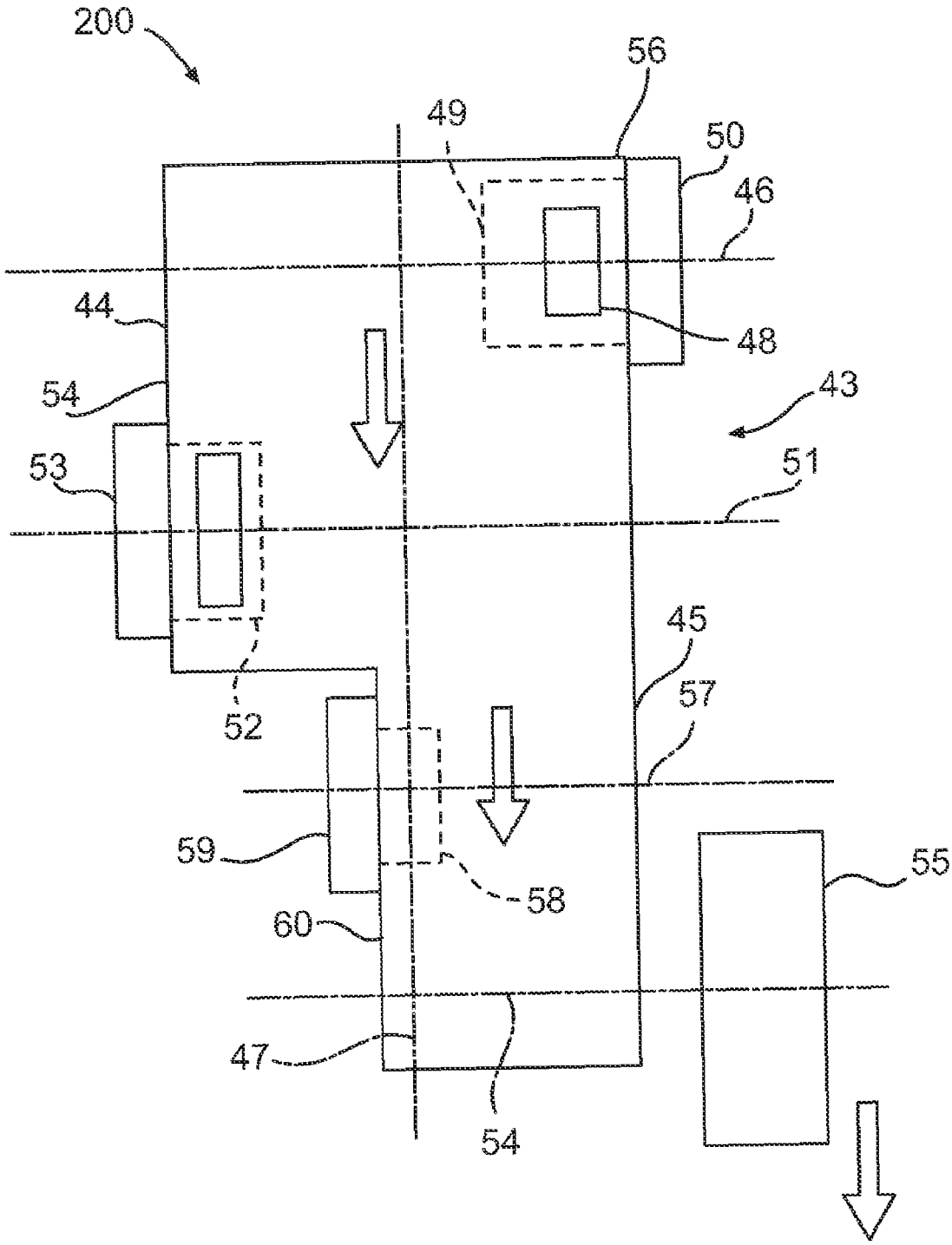
FIG. 4 is a schematic view of an alternative embodiment of the present invention.

FIG. 4 is a schematic illustration of alternative embodiment of the present invention. FIG. 4 illustrates a cross-section of a power unit case 43 of an internal combustion engine 200 taken along the separating plane of the crankcase 44. The crankshaft, the transmission shaft, and the output shaft are arranged along the separating plane (for simplicity, only the axes defined by these components have been illustrated). In the figure, an oil pump shaft axis 57 of an oil pump device of the internal combustion engine 200 has been normally projected onto the separating plane in order to illustrate the positioning of the oil pump shaft axis 57 along the separating plane relative to other components of the engine 200. The oil pump shaft axis 57 is actually located either above or below the separating plane. It is contemplated that the oil pump shaft axis 57 could also be located on the separating plate.

The power unit case 43 has a crankcase 44 and an integrated transmission housing 45. Within the crankcase 44, a crankshaft is supported in bearings so as to rotate about a crankshaft axis 46. The crankshaft has two crankshaft ends. A vertically oriented central plane 47 is arranged perpendicular to the crankshaft and intersects it at its midpoint between the two crankshaft ends. A generator-ignition system 48 is located in an ignition chamber 49 on a first end portion of the crankshaft. The ignition chamber 49 is closed by an ignition cover 50 which forms part of the power unit case 43. The ignition cover 50 is secured to an ignition housing flange 56. The crankshaft is connected to a transmission shaft through a primary drive system, through gears for example. The transmission shaft has a transmission shaft axis 51 as well as a clutch assembly that is disposed in a clutch chamber 52. The clutch chamber 52 is closed by a clutch cover 53 that is secured to a clutch cover flange 54. The clutch chamber can be formed as part of the crank chamber or is at least partially separated from it. The clutch cover 53 forms part of the power unit case 43. Torque is transmitted from the transmission shaft to the output shaft through a gears. The output shaft has an output shaft axis 54 as well as an output wheel 55, for example a notched-belt pulley that is arranged so as to rotate with the output shaft, outside the of power unit case 43. From the notched-belt pulley, torque is transmitted through a notched belt to, for example, an axle of a vehicle such as the rear axle of a motorcycle.

An oil pump is also provided in the power unit case 43. The oil pump has an oil pump shaft that is supported in bearings so as to rotate about an oil pump shaft axis 57. The oil pump also has an oil pump chamber 58 that is defined, closed off, or sealed, at least in part by an oil pump cover 59 that forms part of the power unit case 43. The oil pump cover is located on the side of the power unit case 43 that is opposite to the side where the output wheel 55 is located. The clutch cover 53 and the oil pump cover 59 are separate from one another. The oil pump cover 59 is secured to an oil pump cover flange 60 on the power unit case 43. In a preferred embodiment, a normal projection of the oil pump cover flange 60 onto the central plane 47 does not overlap a normal projection of the clutch cover flange 54 onto the central plane 47. As can be seen from FIG. 4, both the oil pump cover flange 60 and the complete oil pump cover 59 are closer to the central plane 47 than the clutch cover 53 and the clutch cover flange 54. Offsetting the oil pump cover 59 from the clutch cover 53 as shown relative to the central plane 47 provides additional space next to the oil pump cover 59 which can be used, for example, to located auxiliary assemblies.

Figure 5:
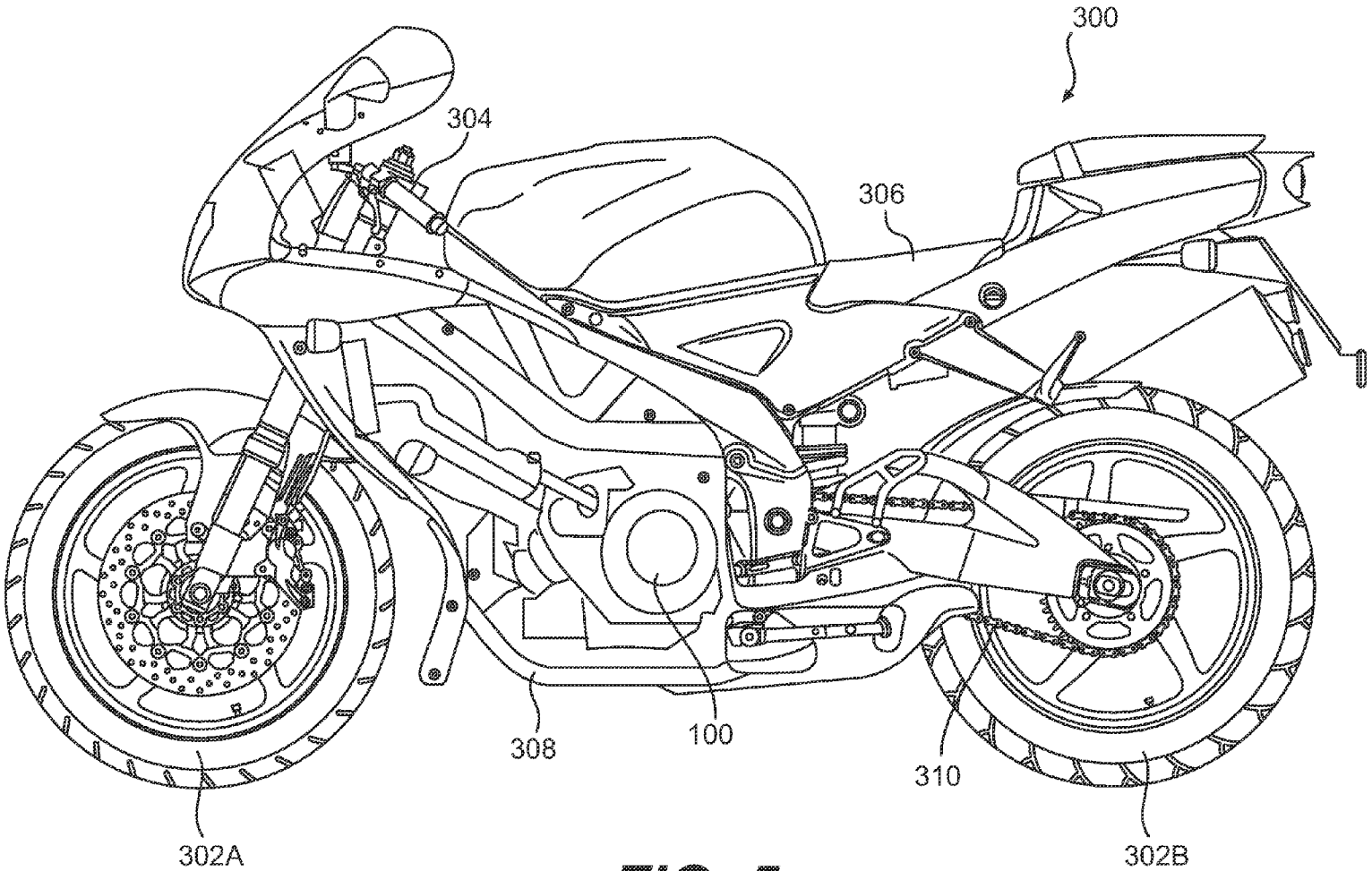
FIG. 5 is a side view of a motorcycle powered by the engine of FIG. 1.

The internal combustion engine 100 could be used to power a motorcycle 300, as shown in FIG. 5. The motorcycle 300 has two wheels 302A, 302B, a handlebar 304 to steer the front wheel 302A, and a straddle-type seat 306. The engine 100 is mounted to the frame 308 of the motorcycle 300 below the seat 306. The engine 100 powers the motorcycle 300 by having the output shaft 22 operatively connected to the rear wheel 302B by a via a chain 310. It is contemplated that the engine 200 could similarly be used to power the motorcycle 300.

Figure 6:
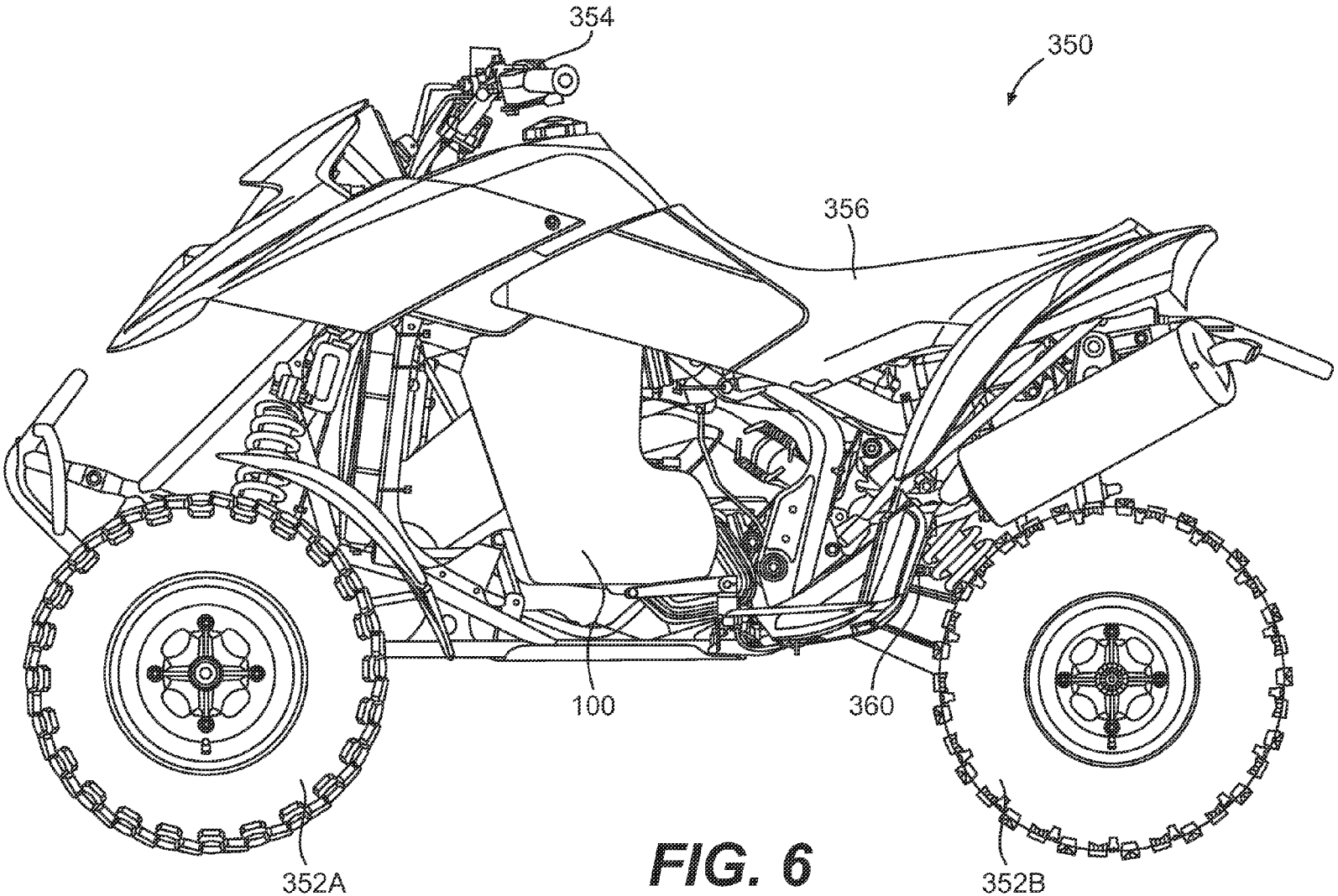
FIG. 6 is a side view of an all-terrain vehicle (ATV) powered by the engine of FIG. 1.

The internal combustion engine 100 could also be used to power an all-terrain vehicle (ATV) 350, as shown in FIG. 6. The ATV 350 has two front wheels 352A, two rear wheels 352B, a handlebar 354 to steer the two front wheels 352A, and a straddle-type seat 356. The engine 100 is mounted to the frame 358 of the ATV 350 below the seat 356. The engine 100 powers the ATV 350 by having the output shaft 22 operatively connected to the two rear wheels 352B by a via a chain 360. It is contemplated that the engine 200 could similarly be used to power the ATV 350.

It is contemplated that the internal combustion engine 100 or 200 described above could also be used to power other motorized recreational vehicle such as three-wheeled straddle-type vehicles, personal watercraft, snowmobiles, sports boats, outboard and inboard marine engines, aircraft, karts, and small utility vehicles.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine comprising:

a power unit case having a crankcase, an integrated transmission housing, a first housing flange and a second housing flange;

a crankshaft having first and second crankshaft ends, the crankshaft being supported for rotation about a crankshaft axis in the crankcase, the power unit case having a central plane defined as a vertical plane being perpendicular to the crankshaft axis and intersecting the crankshaft generally at a midpoint between the two crankshaft ends;

an output shaft supported for rotation about an output shaft axis in the crankcase, the output shaft axis and the crankshaft axis defining a reference plane;

a first oil pump comprising:

a first oil pump chamber disposed at least partially in the power unit case;

an oil pump shaft disposed at least partially in the first oil pump chamber and being supported for rotation about an oil pump shaft axis, a normal projection of the oil pump shaft axis onto the reference plane being located between the crankshaft axis and the output shaft axis; and a first oil pump rotor disposed in the first oil pump chamber on the oil pump shaft so as to rotate therewith about the oil pump shaft axis;

a first housing cover mounted to the first housing flange on a first side of the power unit case, the first housing cover being removable, and, when mounted, forming part of the power unit case, the first housing cover being one of a clutch cover and an ignition cover; and an oil pump cover mounted to the second housing flange on the first side of the power unit case to close the first oil pump chamber, the oil pump cover being removable to provide access to the first oil pump chamber, and when mounted, forming part of the power unit case, the oil pump cover being separate from the first housing cover.

2. The engine of claim 1, further comprising a transmission shaft supported in the transmission housing for rotation about a transmission shaft axis.

3. The engine of claim 2, wherein the crankshaft axis is generally parallel to and spaced apart from both the transmission shaft axis and the output shaft axis.

4. The engine of claim 2, further comprising:

a primary drive disposed on the crankshaft for driving the transmission shaft; and a series of gears disposed on the transmission shaft for driving the output shaft.

5. The engine of claim 2, further comprising:

a clutch chamber, wherein a portion of the transmission shaft is disposed in the clutch chamber; and a clutch disposed on the transmission shaft in the clutch chamber;

wherein the first housing cover is a clutch cover to close the clutch chamber, the clutch cover being removable to provide access to the clutch chamber.

6. The engine of claim 1, further comprising:

an ignition chamber, wherein the first end of the crankshaft is disposed in the ignition chamber; and a generator-ignition system disposed on the first end of the crankshaft in the ignition chamber;

wherein the first housing cover is an ignition cover to close the ignition chamber, the ignition cover being removable to provide access to the ignition chamber.

7. The engine of claim 1, wherein a normal projection of the second housing flange onto the central plane does not overlap a normal projection of the first housing flange onto the central plane.

8. The engine of claim 7, wherein the second housing flange is closer to the central plane than the first housing flange.

9. The engine of claim 1, wherein the second housing flange is closer to the central plane than the first housing flange.

10. The engine of claim 9, wherein the complete oil pump cover is closer to the central plane than the first housing flange.

11. The engine claim 1, further comprising an output wheel disposed on the output shaft for rotation therewith, the output wheel being disposed outside of the power unit case adjacent to the oil pump cover.

12. The engine of claim 11, wherein the output wheel is one of a sprocket and a notched-belt pulley.

13. The engine of claim 9, further comprising an output wheel disposed on the output shaft for rotation therewith, the output wheel being disposed outside of the power unit case, the oil pump cover being closer to the central plane than the output wheel.

14. The engine of claim 9, further comprising an output wheel disposed on the output shaft for rotation therewith, the output wheel being disposed outside of the power unit case, the second flange housing being closer to the central plane than the output wheel.

15. The engine of claim 1, wherein the first oil pump chamber disposed at least partially in the crankcase, a first end portion of the oil pump shaft is disposed in the first oil pump chamber, and the first oil pump rotor is disposed on the first end portion; and further comprising a second oil pump, the second oil pump comprising:

a second oil pump chamber disposed at least partially in the crankcase, a second end portion of the oil pump shaft being disposed in the second oil pump chamber; and a second oil pump rotor disposed in the second pump chamber on the second end portion so as to rotate with the oil pump shaft about the oil pump shaft axis.

16. The engine of claim 15, wherein the first pump is a suction pump and the second pump is a pressure pump.

17. A vehicle comprising:

a frame;

a straddle-type seat mounted to the frame;

at least two wheels mounted to the frame;

a handlebar operatively connected to at least one of the wheels for steering the vehicle; and an internal combustion engine mounted to the frame below the straddle-type seat and operatively connected to at least one of the wheels, the engine comprising:

a power unit case having a crankcase, an integrated transmission housing, a first housing flange and a second housing flange;

a crankshaft having first and second crankshaft ends, the crankshaft being supported for rotation about a crankshaft axis in the crankcase, the power unit case having a central plane defined as a vertical plane being perpendicular to the crankshaft axis and intersecting the crankshaft generally at a midpoint between the two crankshaft ends;

an output shaft supported for rotation about an output shaft axis in the crankcase, the output shaft axis and the crankshaft axis defining a reference plane;

a first oil pump comprising:

a first oil pump chamber disposed at least partially in the power unit case;

an oil pump shaft disposed at least partially in the first oil pump chamber and being supported for rotation about an oil pump shaft axis, a normal projection of the oil pump shaft axis onto the reference plane being located between the crankshaft axis and the output shaft axis; and a first oil pump rotor disposed in the first oil pump chamber on the oil pump shaft so as to rotate therewith about the oil pump shaft axis;

a first housing cover mounted to the first housing flange on a first side of the power unit case, the first housing cover being removable, and, when mounted, forming part of the power unit case, the first housing cover being one of a clutch cover and an ignition cover; and an oil pump cover mounted to the second housing flange on the first side of the power unit case to close the first oil pump chamber, the oil pump cover being removable to provide access to the first oil pump chamber, and when mounted, forming part of the power unit case, the oil pump cover being separate from the first housing cover.

18. The vehicle of claim 17, wherein the vehicle is a motorcycle.

19. The vehicle of claim 17, wherein the at least two wheels are four wheels.

20. The vehicle of claim 19, wherein the vehicle is an all-terrain vehicle.

* * * * *

UNITED STATES PATENT AND TRADEMARK OFFICE
Certificate

Patent No. 7,325,527 B2

Patented: February 5, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Markus Hochmayr, Krenglbach (AT); Herbert Poelz, Mattighofen (AT); and Thomas Kritzinger, Frankenburg (AT).

Signed and Sealed this Twenty-third Day of February 2010.

STEPHEN K. CRONIN
*Supervisory Patent Examiner*
Art Unit 3747